United States Patent [19]

Gilbert et al.

[11] Patent Number: 4,674,154

[45] Date of Patent: Jun. 23, 1987

[54] ELECTRIC KNIFE, PARTICULARLY FOR OPENING OYSTERS

[75] Inventors: Alain Gilbert, Beauvoir-sur-Mer; Jacques Gilbert, Paris, both of France

[73] Assignee: Norlac Plastiques, Beauvoir-sur-Mer, France

[21] Appl. No.: 714,995

[22] Filed: Mar. 22, 1985

[30] Foreign Application Priority Data

Mar. 23, 1984 [FR] France ..... 84 04524

[51] Int. Cl.[4] ..... A22C 29/04

[52] U.S. Cl. ..... 17/75; 30/272 A

[58] Field of Search ..... 17/75, 74; 30/272 A, 30/272 R, 169

[56] References Cited

U.S. PATENT DOCUMENTS 1,838,186 12/1931 Moodhe ..... 30/272 R X
2,307,424 1/1943 Savage ..... 30/272 A
2,718,699 9/1955 Soss ..... 30/272 R
3,491,279 1/1970 Rodaway ..... 30/272 R X

FOREIGN PATENT DOCUMENTS 1432604 2/1966 France ..... 17/75
2040210 8/1980 United Kingdom ..... 30/272 A

*Primary Examiner*—Willie G. Abercrombie
*Attorney, Agent, or Firm*—Brisebois & Kruger

[57] ABSTRACT

An electric oyster knife has a case (1), a blade holder (12) with a blade (13) slidably longitudinally between outer and inner positions with respect to the case, an electromagnet (2) mounted in the case for oscillating the blade holder between its two positions. An armature (7) is pivotally mounted in the case. The armature has a cam surface (11) for driving the blade holder toward its outer position, in a first position of the armature, and for allowing the blade holder to move to its inner position, in a second position of the armature.

7 Claims, 1 Drawing Figure

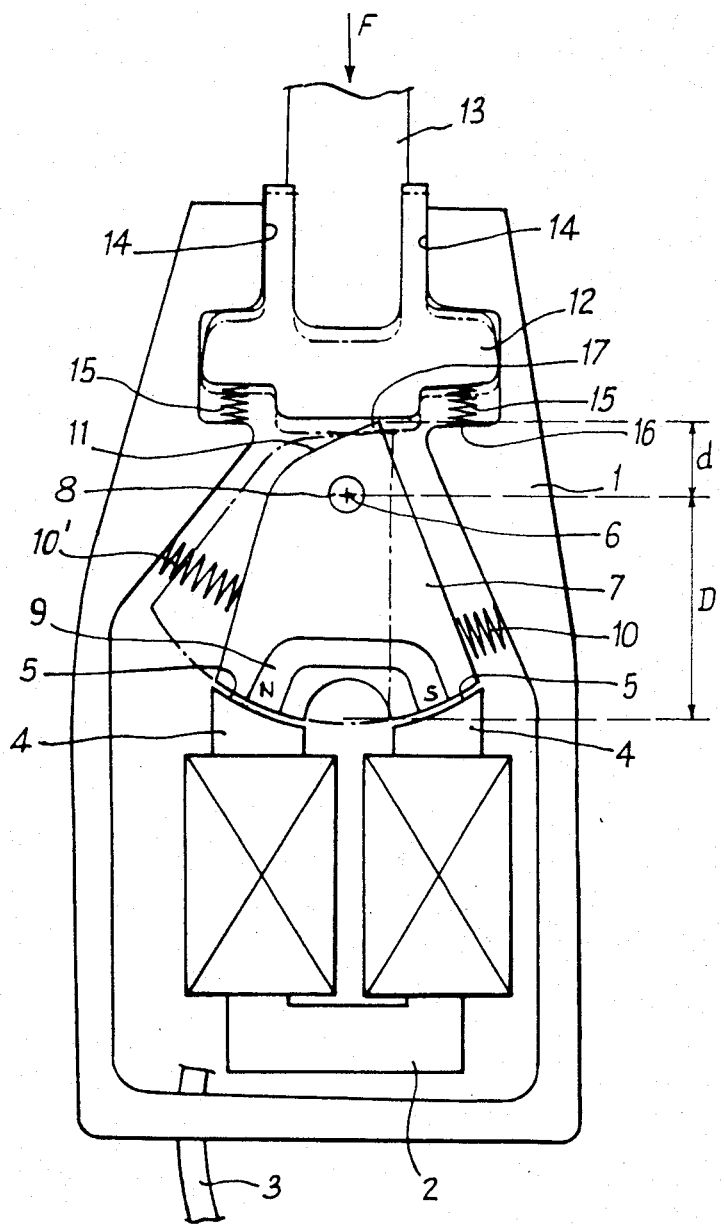
F
13
14
14
12
17
15
15
16
11
d
8
1
6
10'
7
D
9
10
5
N
S
5
4
4
3
2

ELECTRIC KNIFE, PARTICULARLY FOR OPENING OYSTERS

BACKGROUND OF THE INVENTION

The present invention relates to an electric knife for opening oysters, and more particularly to such a knife having a case, a blade holder able to receive a blade and slidable longitudinally between inner and outer positions with respect to the case, and an electromagnetic coil mounted in the case to vibrate the blade holder between its two positions.

Such devices are already known in practice. Because of the vibrations of the blade, the blade can more easily be introduced between the two valves or halves of the shell and thus facilitate opening the oyster.

The known devices however generally have the disadvantage that they lack power and consequently are not very reliable.

The present invention aims to eliminate such disadvantages.

SUMMARY OF THE INVENTION

The invention has as an object an electric knife, particularly for opening oysters, of the type having a case, a blade holder to hold a blade, and able to slide longitudinally between inner and outer positions with respect to the case, and an electromagnetic motor mounted in the case for vibrating the blade between its two positions, characterized by the fact that it has an armature with a cam surface mounted to pivot in the case, the cam oscillating under the action of the electromagnet between a first position in which it forces the blade to hold to the outer position, and a second position in which it allows the blade holder to move or return to its inner position.

Thus, when the cam oscillates under the action of the electromagnet, it drives the blade holder toward its outer position when the cam and armature are in the first position, and then allows the blade holder to return to its inner position under the inward pressure exerted by the user when the cam and armature move toward the second position.

Advantageously, the knife according to the invention has first elastic means to hold the armature near its second position in the absence of the magnetic forces.

Thus, the cam remains in this second position as long as the electromagnet is not energized. When the electromagnet is energized, the electromagnet forces pull the armature toward its first position, which has the effect of starting the vibrating movement and which is transmitted to the blade holder, when the blade holder is in its inner position.

Second elastic means can also be provided to normally urge the blade holder toward its outer position.

Thus, when no force is exerted by the user, tending to move the blade and holder inwardly, the blade holder remains in its outer position. Consequently the armature and cam can oscillate without transmitting vibrations to the blade holder or blade, which ensures a quiet operation and easy position of the non-vibrating blade against the oyster shell.

When a predetermined inward force is exerted on the blade and holder, by the user, the bias of the second elastic means is overcome and blade holder moves inwardly, slightly inside the case. The cam then comes into contact with the blade holder each time the armature moves to its first position, and thus causes the blade and holder to vibrate.

Advantageously, the ratio of the distance between the pivotal axis of the armature and the air gap between the armature and electromagnet on the one hand, to the distance between the pivotal axis and the surface of the cam which engages the blade holder, on the other hand is between two and three to optimize the operation of the knife according to the invention.

One particular embodiment of the invention will now be described as a non-limiting example.

BRIEF DESCRIPTION OF THE DRAWING

The drawing schematically shows an electric knife according to the invention, with one side of the case open.

DETAILED DESCRIPTION

The drawing shows that the knife has a case 1 inside which is mounted an electromagnet 2, supplied with alternating current by an electric supply cord 3 in a known manner.

Electromagnet 2 is U-shaped and has two poles 4 having cylindrical surfaces 5 which curve about axis 6.

An armature 7 is mounted to pivot in case 1 around a shaft 8 centered on axis 6.

A permanent magnet 9 is embedded in or fixed to armature 7 with its two poles in facing aligned relation with the poles 4 of electromagnet 2, when the armature is in a first position, shown on the drawing in solid lines.

A compression spring 10 urges armature 7 away from this first position in the absence of magnetic forces, toward a second position shown on the drawing in phantom lines. A second spring 10' is provided to decelerate the armature, in operation, and also cooperates with spring 10 to hold the armature in an equilibrium position.

A flanged blade holder 12, for holding a blade 13, is mounted to slide in case 1 between an outer position shown in solid lines on the drawing and an inner position shown in phantom lines.

The sliding of blade holder 12 is guided by the surfaces 14 of the case acting with the corresponding surfaces of the blade holder.

Compression springs 15 acting between shoulders 16 of the case and flanges of blade holder 12 tend to maintain the blade holder in its outer position.

Because of the shape of cam surface 11 which has a projection 17, blade holder 12 is also kept in its outer position when armature 7 is in its first position, as shown in solid lines.

In contrast, when armature 7 moves into its second position shown in phantom lines on the drawing, projection 17 lowers or retracts and blade holder 13 can, under the action of a longitudinal force F opposing the force of springs 15, move into its inner position. Thus, when electromagnet 2 is energized it causes an oscillation of armature 7 between its two positions shown on the drawing respectively in solid lines and in phantom lines, which in turn causes reciprocating vibration of blade holder 12, when a force F is exerted on the blade 13 by the user.

On the contrary, if no force is exerted, blade holder 12 remains in its outer position under the action of springs 15 and does not receive vibrations from the oscillating armature and cam.

It has also been noted that the efficiency of the knife according to the invention is optimal when the ratio D/d is between 2 and 3, d being the distance between the axis 6 of rotation of the armature and the air gap between the end faces 5 of poles 4 of the electromagnet, and d being the distance between this same axis 6 and projection 17 of the cam surface 11.

The electromagnet has its coils so arranged that one pole 4 becomes north and the other south when the electromagnet receives a positive half-cycle of alternating current, and the magnetic polarity reverses when the electromagnet receives the negative half-cycle of alternating current. This causes the armature to be alternately attracted by the electromagnet so it moves to the first or solid line position, and then repelled, the action of spring 10 assuring that the armature is repelled toward the phantom line position.

Of course, various changes and modifications can be made in the embodiment described without departing from either the scope or the spirit of the invention.

Thus, for example, springs 10 and 10' could be replaced by a spiral spring, or in some instances possible omitted. Similarly, cam surface 11 has been shown as acting directly on blade holder 12 but a follower or intermediate element can obviously be added.

We claim:

1. An electric oyster knife comprising a case, a blade holder slidable between inner and outer positions with respect to the case, said blade holder being adapted to hold and retain an oyster knife blade, electromagnetic motor means in said case to vibrate the blade holder and a blade held thereby between the inner and outer positions, said electromagnetic motor means comprising an electromagnet in said case, an armature in said case mounted for pivotal movement about an axis, relative to said electromagnet, a cam surface on said armature, said armature being pivotally movable between a first position in which the cam surface drives the blade holder to said outer position, and a second position in which the blade holder can return to said inner position.

2. An electric oyster knife according to claim 1 further comprising first elastic means for maintaining said armature in said second position when said electromagnet is unenergized.

3. An electric oyster knife according to claim 2 wherein said armature drives and vibrates said blade holder only when the blade holder is in said inner position, and second spring means for urging the blade holder toward said outer position so that the blade holder is vibrated by the armature only when it is forced inwardly against the action of said spring means.

4. An oyster knife according to claim 1 wherein said armature is mounted for pivotal movement about an axis between said blade holder and said electromagnet, said armature is between said blade holder and the electromagnet, a pole of said armature faces toward a pole of the electromagnet and the poles are separated by air gap, said cam surface of the armature faces toward the blade holder, and the ratio of the distance between the axis of pivotal movement of the armature, and the air gap and cam surface is between 2 and 3.

5. An oyster knife according to claim 1 wherein said electromagnet comprises a first pole and a second pole facing toward said armature, and at the same distance from the axis of pivotal movement of the armature, said armature comprises first and second poles of the electromagnet by an air gap, said first spring means pivots said armature to said second position out of alignment with the poles of the electromagnet, and said electromagnet, when energized, pivots the armature against the action of the first spring means to said first position in alignment with the poles of the electromagnet.

6. An electric oyster knife according to claim 5 wherein said electromagnet is energized with alternating current so that said pole pieces of the electromagnet have opposite polarity during a positive half cycle of the alternating current, and reversed opposite polarity during a negative half cycle of the alternating current, said armature includes a permanent magnet providing armature poles of opposite polarity, so that the electromagnet alternately attracts and repels the armature during alternate positive and negative half cycles of the alternating current.

7. An electric oyster knife according to claim 6 wherein the permanent magnet is embedded in the armature.

* * * * *